US005505382A

United States Patent [19]

Sealy et al.

[11] Patent Number: 5,505,382

[45] Date of Patent: Apr. 9, 1996

[54] APPARATUS FOR DISTRIBUTING LIQUID SOLUTIONS

[76] Inventors: J. Michael Sealy, 7808 Southwestern, Dallas, Tex. 75225; Y. C. Cheng, 443 Castle Peak Road, Kwai Chung, New Territories, Hong Kong

[21] Appl. No.: 242,775

[22] Filed: May 16, 1994

[51] Int. Cl.[6] ..... B05B 7/30

[52] U.S. Cl. ..... 239/316; 137/892; 285/161; 239/317; 239/318

[58] Field of Search ..... 239/310, 316, 239/317, 318, 152, 153, 154; 137/888, 892, 564.5, 205.5; 285/161

[56] References Cited

U.S. PATENT DOCUMENTS

| | | | |
|---|---|---|---|
| 811,749 | 2/1906 | Somers | 239/317 |
| 1,458,975 | 6/1923 | Clauson | 239/317 |
| 1,947,994 | 2/1934 | Larson | 137/888 |
| 2,057,434 | 10/1936 | Jaden et al. | 239/318 |
| 2,571,870 | 10/1951 | Hayes | 239/318 |
| 3,017,118 | 1/1962 | Kane | 239/310 |
| 3,776,468 | 12/1973 | Davenport | 239/310 |
| 3,943,960 | 3/1976 | Syrenne | 239/317 |
| 4,527,740 | 7/1985 | Gunzel, Jr. et al. | 239/318 |
| 5,133,498 | 7/1992 | Sealy et al. | 239/310 |
| 5,188,294 | 2/1993 | Sealy et al. | 239/310 |

FOREIGN PATENT DOCUMENTS

| | | | |
|---|---|---|---|
| 18928 | of 1909 | United Kingdom | 239/317 |

*Primary Examiner*—Andres Kashnikow
*Attorney, Agent, or Firm*—Konneker & Bush

[57] ABSTRACT

The present invention is directed to a liquid dispensing apparatus such as those used in the application of liquid chemicals to a lawn. The liquid dispensing apparatus is comprised of a first wall, which can also serve as a handle, with a first inlet portion for receiving a pressurized fluid from an outside source, a first outlet portion for dispensing fluid into a container, a second inlet portion for receiving fluid from the container and a second outlet portion for dispensing a fluid from the liquid dispensing apparatus. An attachment on either or both ends of the first wall allows the apparatus to be removably attached to an external pressurized fluid supply source and an external dispensing apparatus such as a lawn sprinkler. Included in the first wall is a means for removably attaching the liquid distribution system to the exterior of a container through an opening or openings within the exterior of the container.

17 Claims, 1 Drawing Sheet

APPARATUS FOR DISTRIBUTING LIQUID SOLUTIONS

BACKGROUND OF THE INVENTION

1. Field of the Invention

This invention relates to systems for distributing liquid solutions over a wide area and, more particularly, to an apparatus for both directing a liquid flow into a fluid container structure and drawing a liquid solution for distribution therefrom.

2. Description of Related Art

Liquid distribution systems that can be connected to a pressurized fluid supply, for example, a garden hose coupled to a commercial water distribution system, for dispensing water over a wide area, for example, a lawn are well known in the art. Equally well known in the art are liquid distribution systems which include a device or other structure to divert water from the liquid distribution system to a fluid container structure where the water is mixed with lawn care chemicals, for example, fertilizers and/or pesticides, in either liquid or solid form. The water/lawn care chemical mixture is then returned to the liquid distribution system for dispersement onto the lawn.

Certain ones of these devices are self contained units in that, on one side, an inlet is provided for interconnecting the device to the pressurized fluid supply and, on the other side, an outlet is provided from which a mixture of the supplied water and lawn care chemical is returned to the liquid distribution system. For example, U.S. Pat. Nos. 5,133,498 and 5,188,294, both to Sealy et al., disclose a device for dispensing a mixture of water and a lawn care chemical. The device includes a fluid container structure having a sidewall in which inlet and outlet ports for respective coupling with a pressurized fluid supply and a liquid distribution system, are provided. Interconnected between the inlet and outlet ports is a liquid conduit which includes a diverter valve for diverting water from the conduit into the interior of the fluid container structure, a liquid volume controller for controlling the amount of liquid passing through the conduit and a venturi for drawing liquid diverted into the interior of the fluid container structure back into the liquid conduit. Access to the diverter valve, liquid volume controller, venturi and the interior of the fluid container structure is limited by a lid structure which may be lockingly engaged with the sidewall of the fluid container structure.

While configured in a very desirable fashion, there are several aspects in which the aforementioned dispensing device could be improved. As previously mentioned, the liquid diverting and mixture drawing components are fixedly secured to the fluid container structure. Thus, in order to use the liquid diverting and mixture drawing components, the consumer must also purchase the fluid container and lid structures. Not only does this unnecessarily add to the cost of purchasing such a system, many consumers who already own fluid container and lid structures, are forced into purchasing duplicative items. Finally, when configured in the aforementioned manner, the replacement cost for such systems are dramatically increased. As one can readily appreciate, the liquid diverting and mixture drawing structures constitute an appreciable portion of the cost of such systems. However, when configured in the aforementioned manner, many consumers would be obliged to replace the entire system if only the fluid container or lid structures became cracked or otherwise damaged.

When the mixture of water and lawn care chemicals are to be distributed over particularly large yards, the devices which mix water and chemicals must often be moved from location to location. However, devices such as that previously described tend to be relatively difficult to move from place to place. In particular, carrying the fluid container structure can often be unwieldy. If it was possible to position one or more fluid container structures at desired locations and then transport the liquid diverting and mixture drawing structures to each of these locations, a significant "ease of use" problem would be solved. While certain configurations, see, for example, U.S. Pat. No. 4,527,740 to Gunzel, Jr. et al., of these devices may be considered to be of the "hand-held" type and would, therefore, be easier to transport between locations, such devices tend to have the liquid diverting and mixture drawing structures permanently attached to the lid structure which attaches to a container from which the diverted fluid mixture is drawn. Thus, once again, the liquid diverting and mixture structures, the fluid container structure and the lid structure are commercially sold as a single unit, again adding to the cost of purchasing or replacing such a system. In addition, these systems are usually small in size and the dispensing nozzle of the device is typically designed for directly dispensing the fluids from the unit onto the lawn and thus does not have any means for connecting the device to another liquid dispensing apparatus such as a lawn sprinkler. This disadvantageous design, therefore, requires the user to continuously hold the unit until application is complete.

It would be desirable, therefore, to provide a hand-held, readily portable device, couplable with a pressurized fluid supply and a liquid distribution system, for diverting water from the pressurized fluid supply to a desired destination such as a stand-alone fluid container structure and for drawing a mixture of the diverted water and a lawn care chemical from the stand-alone fluid container structure and into a liquid distribution system. Accordingly, it is an object of this invention to provide such a device.

SUMMARY OF THE INVENTION

The present invention provides a device, couplable to a pressurized fluid supply and a liquid distribution system, for diverting liquid to and drawing liquid from a fluid container structure in which the device is removably attachable to the exterior of the fluid container structure. In a preferred embodiment thereof, a first wall means, representatively a cylindrical conduit, defines a main fluid distribution passage. The wall means has a first inlet opening for receiving a fluid from an external source. Adjacent to the first inlet opening is a first outlet portion for discharging fluid into a fluid container structure, representatively a diverter valve. On the end opposite the first inlet portion of the main fluid distribution passage is a second outlet portion for discharging the fluid externally from the distribution passage, and a second inlet portion for receiving fluid from the fluid container structure that is connected to a narrowed segment of the first wall means, representatively a venturi valve. Preferably, the length of the first wall means is sufficient to allow the liquid distribution system to serve as an easily graspable handle if so desired. Connected to the second inlet portion is a second wall means, representatively a tubular conduit, that interconnects with and extends downwardly from the second inlet portion into a chemical mixture within the fluid container structure that is to be dispensed onto the lawn.

The wall means of the device also includes a means for attaching the system to the exterior of the fluid container structure, preferably a lid structure portion of the fluid container structure. The preferred attachment means comprises a threaded portion that depends from the wall means of the liquid distribution system and a threaded locknut that is cooperatively engageable with the threaded portion depending from the wall means. An opening in the exterior surface of the fluid container structure is adapted to receive the depending threaded portion of the wall means and allows the system to be removably attached to the container structure when the threaded portion of the locknut is engaged with the threaded portion of the wall means. Additionally, the preferred embodiment includes a means for removably attaching the first inlet portion of the wall means to an external fluid supply source and a means for removably attaching the second outlet portion to a dispensing apparatus such as a garden hose attached to a lawn sprinkler.

DETAILED DESCRIPTION

Figure 1:
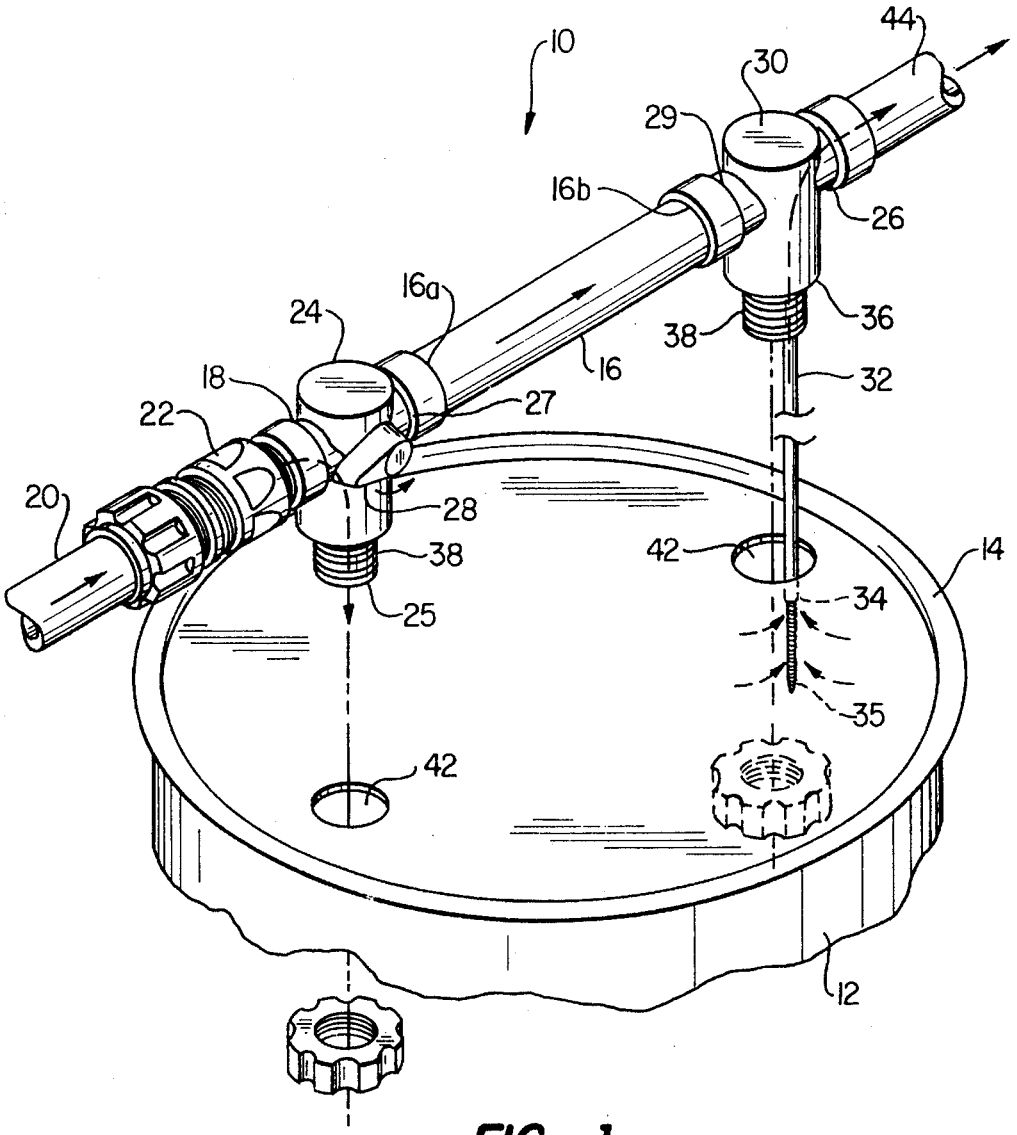
FIG. 1 is a partially exploded, perspective view of a device, couplable to a pressurized fluid supply and a liquid distribution system and constructed in accordance with the teachings of the present invention, for diverting liquid to and drawing liquid from an associated fluid container structure in which the device is removably attachable to an lid structure portion of the fluid container structure.

Referring initially to FIG. 1, in a preferred embodiment thereof, the present invention incorporates a device 10 for diverting liquid from a pressurized fluid supply to a container 12 and for drawing liquid from the container 12 back into the device 10 where it may then be transported to a liquid distribution system and means for removably attaching the device 10 to the exterior surface of the container 12, preferably to a removable attachable lid 14 of the container 12. The preferred embodiment of the device 10 covered by the present invention is similar in some respects, as will be discussed below, to certain aspects of the apparatus for dispensing a material described and illustrated in U.S. Pat. Nos. 5,133,498 and 5,188,294, both to Sealy et al., and which are hereby incorporated by reference as if reproduced in their entirety.

The device 10 has a first wall means 16 which defines a main fluid distribution passage 17 (illustrated in phantom in FIG. 2) for the transmission of fluid through the first wall means 16. The first wall means 16 includes an inlet portion **16*a* for receiving, in a manner to be more fully described below, fluid from an external pressurized fluid source 20, such as water from a garden hose, via diverter valve 24 and an outlet portion 16*b* for discharging water passing through the fluid distribution passage 17 to a venturi valve 30 which, as more fully described below, discharges either water supplied to the fluid distribution passage 17 or a mixture of water supplied to the fluid distribution passage 17 and a liquid solution drawn from the container 12 to a liquid distribution system 44 coupled to the outlet of the venturi valve 30**.

The diverter valve 24 includes an inlet portion 18 for receiving fluid from the external fluid source 20, and an attachment means 22 for attaching the first inlet portion 18 to the external fluid source 20. The attachment means 22 can be any type of conventional means for removably attaching two fluid conduits together, for example, such as cooperating threads on the inlet portion 18 of the diverter valve 24 and the external fluid source 20, or a quick release coupling means. The diverter valve further includes first and second outlet portions 25, 27 for respectively directing fluid into the container 12 or the fluid passageway 17.

Figure 2:
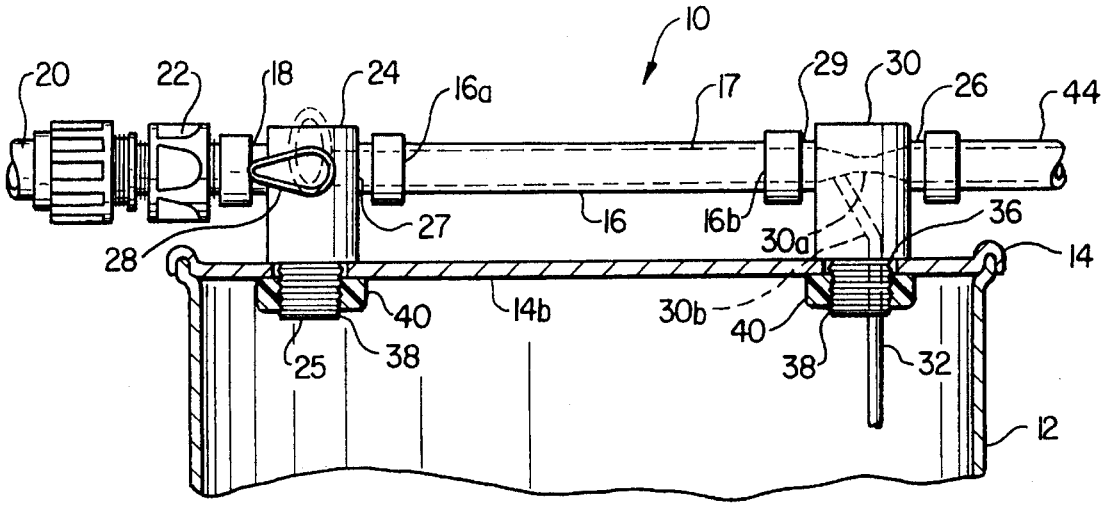
FIG. 2 is a partial cross-sectional view of the device of FIG. 1 attached to the lid structure portion of the fluid container structure.

The diverter valve 24 includes has a control lever 28 movable between a first position, illustrated in FIG. 1, in which the fluid entering the inlet portion 18 of the diverter valve 24 is directed such that it exits the diverter valve 24 through the second outlet portion 27 where it flows into the fluid passageway 17 and a second position, illustrated in phantom in FIG. 2, in which the fluid entering the inlet portion 18 of the diverter valve is directed such that it exits the diverter valve 24 through the first outlet portion 25 where it flows into the container 12. For example, the diverter valve 24 may have first and second interior passageways formed therein such that, in the first position, the first interior passageway is in communication with the inlet portion 18 and the second outlet portion 27 and the second interior passageway is not in communication with the inlet portion 18, thereby causing water entering the diverter valve 24 to be directed into the second outlet portion 27 where the water exits the diverter valve 24 and enters the fluid passageway 17 and, in the second position, the first interior passageway is no longer in communication with the inlet portion 18 while the second interior passageway is in communication with the inlet portion 18 and the second outlet portion 27, thereby causing water entering the diverter valve 24 to be directed into the first outlet portion 25 where water exits the diverter valve 24 and enters the container 12.

Coupled to the outlet end **16*b* of the first wall means 16 is the venturi valve 30. The venturi valve 30 includes a first inlet portion 29 for receiving water exiting the outlet portion 16*b* of the first wall means 16, a second inlet portion 36 for receiving a liquid mixture from the container 12 and an outlet portion for discharging a mixture of water received from the fluid passageway 17 and liquid drawn from the container 12 to a liquid distribution system 44. It should be noted that, while the liquid distribution system 44 is represented as a single conduit, it is fully contemplated that the liquid distribution system 44 may include irrigation and/or sprinkler systems. Furthermore, while the liquid distribution system 44 is shown directly coupled to the outlet portion 26 of the venturi valve 30, it is anticipated that a coupling system similar to the attachment means 22 coupling the inlet portion 18 of the diverter valve 24 to the external fluid source 20 would be necessary to complete the interconnection therebetween. For ease of illustration, however, the drawings do not illustrate the coupling system between the venturi valve 30 and the liquid distribution system 44**.

Interconnected with the second inlet portion 36 is a second wall means 32, representatively illustrated in FIG. 1 as a tubular conduit member. The second wall means 32 has a first open end portion 34 that extends downwardly and that can be positioned within the interior of container 12, thereby bringing the first open end 34 into contact with the chemical fluid mixture in the container 12 and a second end that is connected to the second inlet portion 36.

As illustrated in phantom in FIG. 2, the venturi valve 30 includes a first interior passageway **30*a* in communication with the first inlet portion 29 and the outlet portion 26 and a second interior passageway 30*b* in communication with the tubular conduit member 32 and a converging portion of the first interior passageway 30*a*. When the control lever 28 is moved into the first position, and fluid entering the diverter valve 26 is directed through the interior fluid passageway 17 and into the interior passageway 30***a* of the venturi valve 30, the venturi effect will draw liquid from the container 12 into the interior passageway 30*a* where it will be mixed with water from the fluid passageway 17. The mixture of water from the external fluid supply 20 and liquid from the container 12 will then exit the outlet portion 26 of the venturi valve 30 where it will be supplied to the liquid distribution system 44.

Referring now to FIGS. 1 and 2, those features of the device 10 which permit it to be readily coupled to a container structure 12 in accordance with the teachings of the present invention will now be described in greater detail. Depending from the second outlet portion 28 of the diverter valve 24 is a first means for attaching the device 10 to the exterior surface of the container 12, representatively illustrated in FIG. 1 as a depending threaded portion 38 which extends downwards from the second outlet portion 28 with a cooperably engageable threaded locknut 40. Similarly, depending from the second inlet portion 36 of the venturi valve 30 is a second means for attaching the device 10 to the exterior surface of the container 12, again representatively illustrated in FIG. 1 as a depending threaded portion 38 which extends downwardly from the second inlet portion 36 with a cooperably engageable threaded locknut 40. When the device 10 is removably attached to the lid 14, the threaded portions 38 of the outlet portion 28 of the diverter valve 24 and the second inlet portion 36 of the venturi valve 30 extend through openings 42 in the lid 14 and the threaded locknuts 40 are engaged with the threaded portions 38 so as to securely engage the locknuts 40 and those parts of the first outlet portion 25 of the diverter valve 24 and the second inlet portion 36 of the venturi valve 30 which extend through the apertures 42 against a lower side surface 14b of the lid 14.

While the preferred embodiment illustrated therein shows first and second engagements between the threaded portions 38 of the first outlet portion 25 of the diverter valve 24 and the second inlet portion 36 of the venturi valve 30, respectively, and the corresponding locknuts 40, it will be appreciated that only one of the portions 25, 36 need be threadedly engaged to accomplish the desired result while the other may simply extend through the aperture 42 and remain unsecured. Furthermore, it will, of course, be understood by those skilled in the art that the means for removably attaching the device 10 to the container 12 is not limited to the means illustrated in the preferred embodiment disclosed herein. Any type of attachment means known in the art that can disengageably secure a member extending through an aperture in a wall to that wall may be used in place of the means illustrated in the preferred embodiment disclosed herein.

With a preferred embodiment of the removably attachable device 10 having been described, a description of its operation will now be discussed. Prior to the present invention, if a person wanted to apply a liquid chemical to their lawn, they would purchase a liquid dispensing apparatus unit that was attachable to their garden hose. The unit would typically be comprised of a container and a permanently mounted dispensing apparatus integrally attached thereto. This system is disadvantageous because when one of the component members of the system breaks, the user would have to buy a complete new unit. This system not only wastes the raw materials involved in the manufacturing process but it can also be needlessly costly to the consumer.

The present invention provides a unique solution to this problem. When the user desires to use the present device 10, he first attaches the device 10 to the irrigation system by coupling the first inlet portion 18 of the diverter valve 24 to the external fluid supply 20 and coupling the outlet portion 26 of the venturi valve 30 to the liquid distribution system 44. If the attachment means is the conventional corresponding threaded portions, the respective components are simply screwed together. If the attachment means is a quick release coupling means such as coupler 22, the respective components can be connected by simply snapping the couplings together. The device 10 may then be mounted to the removably attachable container lid 14 by positioning the threaded portions 38 of the second outlet portion 28 of the diverter valve 24 and the second inlet portion 36 of the venturi valve 30 through the respective openings 42 in the lid 14 and mounting the device 10 to the lid 14 by securing the locknuts 40 to the threaded portions 38.

Upon mounting the device 10 to the lid 14, the container 12 may be filled with a lawn care product, for example, liquid or solid fertilizer or pesticide. After the composition to be mixed with the fluid is placed in the interior of the container 12, the lid 14 can then be removably attached to the container 12. The control handle 28 of the diverter valve 24 is then moved into the second position and the pressurized external fluid supply 20 is turned on. By doing so, the external fluid supply 20 will begin to supply water to the device 10. As the control handle 28 of the diverter valve is in the second position, water entering the inlet portion 18 of the diverter valve 24 will be diverted to the first outlet portion 25 where the water exits the diverter valve 24 and enters the container 12 for mixing with the material deposited therein. After sufficient mixing has taken place, for example, when the container 12 is about half to three-quarters full, the control handle 28 is then returned to the first position whereby water entering the inlet portion 18 of the diverter valve 24 will be diverted to the second outlet portion 27 where the water exits the diverter valve 24 and enters the fluid passageway 17 of the first wall means 16. Water supplied to the fluid passageway 17 will then pass through the venturi valve 30 and exit the device 10 via the outlet portion 26. The fluid then proceeds through and exits the liquid distribution system 44, thereby dispensing the fluid onto the lawn. Since, the present invention provides the unique feature of a device 10 that can be connected to a container 12, it is not necessary for the user to continuously hold the device. This aspect of the present invention frees the user to do other things as desired.

As the external fluid passes through the venturi passage, the reduced pressure causes a vacuum which draws the mixture in the interior of the container 12 through the first open end 34 of the second wall means 32. If desired, a filter 35 may be attached to the first open end 34 to prevent solid matter from being drawn into the second wall means 32. The fluid is then drawn into the second inlet portion 36 of the venturi valve 30 where the second wall means 32 is in communication with the second interior passageway 30*b*. Finally, the fluid is drawn into interior passageway 30*a* where the fluid is mixed with water passing through the interior passageway 30*a* of the venturi valve 30. The mixture is then carried out of the device 10 through the outlet portion 26 of the venturi valve 30 where the mixture enters the liquid distribution system 44.

One advantageous feature to is that the device 10 is suitable for use with any container 12 having an apertured lid 14 engagable therewith. Accordingly, a series of containers 12 may be provided at stationary locations and the device 10 coupled to each container 12, used in the above described manner and then transported to another container 12. Alternately, if all of the plural containers 12 are selected to have the same diameter, the device 10 may be coupled to a lid 14 sized to fit each of the containers 12 and the device 10/lid 14 transported to each of the plural containers 12 where the lid 14 may be placed on the container 12, the device 10 connected to the pressurized external fluid supply 20 and the liquid distribution system 44 and then used to disperse a mixture over a selected area. For this reason, the wall means 16 coupled to the diverter valve 24 and the venturi valve 30 is sized such that it forms a handle suitable for carrying either the device 10 or the device 10 coupled to the lid 14.

In the event that either the container 12, the lid 14, or the device 10 breaks, the user may easily remove the device 10 from the exterior surface of the container 12 by simply disengaging the locknuts 40 from the threaded portions 38 and disconnecting the device 10 from the external fluid source 20 and the liquid distribution system 44. The broken component may then be replaced while the remaining components are reused.

The foregoing detailed description is to be clearly understood as being given by way of illustration and example only, the spirit and scope of the present invention being limited solely by the appended claims.

What is claimed is:

1. An apparatus for diverting a fluid into a container and for drawing a mixture of said fluid and a composition from said container, said container having a sidewall which defines an interior portion which holds said composition, said apparatus comprising:

a first wall means for defining a fluid distribution passage, said first wall means having a first inlet portion adapted for receiving fluid from an external source, a first outlet portion adapted for discharging said fluid into said interior portion of said container holding said composition to be mixed therewith, a second inlet portion adapted for receiving, as a liquid solution, a mixture of said fluid and said composition from said container, and a second outlet portion adapted for externally discharging said liquid solution from said first wall means;

a second wall means having a first, open, end positionable within said interior portion of said container and a second end connected to said second inlet portion of said first wall means;

a lid adapted for mating with said sidewall of said container, said lid having a lower side surface side surface and first and second apertures formed therein;

a portion of said first outlet portion of said first wall means extending through said first aperture and a portion of said second inlet portion of said first wall means extending through said second aperture;

first attachment means for removably securing said portion of said first outlet portion of said first wall means which extends through said first aperture to said lower side surface of said lid; and second attachment means for removably securing said portion of said second inlet portion of said first wall means which extends through said second aperture to said lower side surface of said lid.

2. The apparatus according to claim 1 wherein said first wall means further comprises:

a diverter valve interconnected with said first inlet portion and said first outlet portion, said diverter valve being movable between a first position whereby the fluid supplied to said first inlet portion flows through said first wall means and exits said second outlet portion, and a second position whereby fluid supplied to said first inlet portion is diverted into said container through said first outlet portion.

3. The apparatus according to claim 1 wherein said first wall means further comprises a narrowed fluid passage segment within said fluid distribution passage, said narrowed fluid passage segment interconnected with said second inlet portion.

4. The apparatus according to claim 1 wherein said first wall means further comprises:

a diverter valve interconnected with said first inlet portion and said first outlet portion, said diverter valve being movable between a first position whereby the fluid supplied to said first inlet portion flows through said first wall means and exits said second outlet portion, and a second position whereby fluid supplied to said first inlet portion is diverted into said container through said first outlet portion; and a narrowed fluid passage segment within said fluid distribution passage, said narrowed fluid passage segment interconnected with said second inlet portion.

5. The apparatus according to claim 1 wherein said portion of said first outlet portion of said first wall means which extends through said first aperture includes a threaded portion and wherein said first attachment means for removably securing said portion of said first outlet portion of said first wall means to said lower side surface of said lid further comprises a first threaded nut, said first threaded nut cooperable with said threaded portion of said first outlet portion of said first wall means to securedly engage said threaded portion of said first outlet portion of said first wall means to said lower side surface of said lid.

6. The apparatus according to claim 5 wherein said portion of said second inlet portion of said wall means which extends through said second aperture includes a threaded portion and wherein said second attachment means for removably securing said portion of said second inlet portion of said first wall means to said lower side surface of said lid further comprises a second threaded nut, said second threaded nut cooperable with said threaded portion of said second inlet portion of said first wall means to securedly engage said threaded portion of said second inlet portion of said first wall means to said lower side surface of said lid.

7. The apparatus of claim 6 wherein said first wall means further comprises a means for removably attaching said first inlet portion to an external source of fluid and a means for attaching said second outlet portion to an external fluid dispensing apparatus.

8. The apparatus according to claim 7 and further comprising a handle means.

9. The apparatus according to claim 8 wherein said handle means is the said first wall means.

10. An apparatus for diverting a fluid into a container structure and for drawing a mixture of said fluid and a composition from said container structure, said container structure having a sidewall which defines an interior portion which holds said composition, said apparatus comprising:

a diverter valve having an inlet portion and first and second outlet portions, said diverter valve movable between a first position whereby liquid supplied to said diverter valve exits said first outlet portion and a second position whereby liquid supplied to said diverter valve exits said second outlet portion;

a lid structure adapted for mating with said sidewall of said container structure, said lid structure having first and second apertures formed therein;

said second outlet portion of said diverter valve extending through said first aperture and positionable within said interior portion of said container structure;

first attachment means for removably attaching said second outlet portion of said diverter valve to said lid structure;

a first liquid conduit having an inlet portion coupled to said first outlet portion of said diverter valve and an outlet portion;

a venturi valve having a first inlet portion coupled to said outlet portion of said first liquid conduit, a second inlet portion and an outlet portion;

said second inlet portion of said venturi valve extending through said second aperture and positionable within said interior portion of said container structure;

a second liquid conduit having a first, open, end positionable within said interior portion of said container structure and a second end coupled to said second inlet portion of said venturi valve; and second attachment means for removably attaching said second inlet portion of said venturi valve to said lid structure.

11. The apparatus according to claim 10 and further comprising a means for removably attaching said first inlet portion of said diverter valve to an external source of fluid and a means for attaching said outlet portion of said venturi valve to an external fluid dispensing apparatus.

12. The apparatus according to claim 10 wherein said first attachment means for removably attaching said second outlet portion of said diverter valve to said lid structure further comprises:

a second, threaded portion of said second outlet portion of said diverter valve; and a first threaded locknut;

said first threaded locknut cooperably engageable with said threaded portion of said second outlet portion of said diverter valve to securedly engage said second outlet portion of said diverter valve to said lid structure.

13. The apparatus according to claim 12 wherein said second attachment means for removably attaching said second inlet portion of said venturi valve to said lid structure further comprises:

a second, threaded portion of said second inlet portion of said venturi valve; and a second threaded locknut;

said second threaded locknut cooperably engageable with said threaded portion of said second inlet portion of said venturi valve to securedly engage said second inlet portion of said venturi valve to said lid structure.

14. A liquid distribution apparatus for dispensing a mixture of a liquid and a material comprising:

a container having a base and at least one sidewall which defines an interior of said container;

a lid removably attachable to said sidewall of said container, said lid having first and second apertures formed therein;

a diverter valve having an inlet portion and first and second outlet portions, said diverter valve movable between a first position whereby liquid supplied to said diverter valve exits said first outlet portion and a second position whereby liquid supplied to said diverter valve exits said second outlet portion;

said second outlet portion of said diverter valve extending through said first aperture and into said interior portion of said container structure;

a handle having a first end coupled to said diverter valve and a second end, said handle having an interior fluid passageway having openings at said first and second ends, said opening at said first end in communication with said first outlet portion of said diverter valve;

a venturi valve having a first inlet portion coupled to said handle, a second inlet portion and an outlet portion, said first inlet portion in communication with said opening of said interior fluid passageway at said second end;

said second inlet portion of said venturi valve extending through said second aperture and into said interior portion of said container structure;

a second liquid conduit having a first, open, end positioned within said interior portion of said container structure and a second end coupled to said second inlet portion of said venturi valve whereby the flow of liquid through said venturi valve draws a mixture of liquid and said composition through said second liquid conduit and into said venturi valve;

first attachment means for removably attaching said second outlet portion of said diverter valve to said lid structure; and second attachment means for removably attaching said second inlet portion of said venturi valve to said lid structure.

15. The apparatus according to claim 14 and further comprising a means for removably attaching said first inlet portion of said diverter valve to an external source of fluid and a means for attaching said outlet portion of said venturi valve to an external fluid dispensing apparatus.

16. The apparatus according to claim 14 wherein said first attachment means for removably attaching said second outlet portion of said diverter valve to said lid structure further comprises:

a second, threaded portion of said second outlet portion of said diverter valve; and a first threaded locknut;

said first threaded locknut cooperably engageable with said threaded portion of said second outlet portion of said diverter valve to securedly engage said second outlet portion of said diverter valve to said lid structure.

17. The apparatus according to claim 16 wherein said second attachment means for removably attaching said second inlet portion of said venturi valve to said lid structure further comprises:

a second, threaded portion of said second inlet portion of said venturi valve; and a second threaded locknut;

said second threaded locknut cooperably engageable with said threaded portion of said second inlet portion of said venturi valve to securedly engage said second inlet portion of said venturi valve to said lid structure.

* * * * *